US007081183B2

(12) United States Patent
Duggirala et al.

(10) Patent No.: US 7,081,183 B2
(45) Date of Patent: Jul. 25, 2006

(54) METHOD OF DERESINATING PULP USING ALKYL ALCOHOL ALKOXYLATE SURFACTANTS

(75) Inventors: Prasad Y Duggirala, Naperville, IL (US); James J. Svarz, Naperville, IL (US)

(73) Assignee: Nalco Company, Naperville, IL (US)

( * ) Notice: Subject to any disclaimer, the term of this patent is extended or adjusted under 35 U.S.C. 154(b) by 37 days.

(21) Appl. No.: 10/201,332

(22) Filed: Jul. 23, 2002

(65) Prior Publication Data

US 2004/0016526 A1 Jan. 29, 2004

(51) Int. Cl.
*D21C 3/20* (2006.01)

(52) U.S. Cl. ..... 162/72; 162/76; 162/77; 162/90; 162/17

(58) Field of Classification Search ..... 162/72, 162/75–77, 82, 83, 179, 158, 17, 19, 25, 162/26, 29, 37–39, 50, 70, 90, 164.1, DIG. 2, 162/DIG. 3; 510/421; 516/DIG. 1
See application file for complete search history.

(56) References Cited

U.S. PATENT DOCUMENTS

| | | | | |
|---|---|---|---|---|
| 3,909,345 | A * | 9/1975 | Parker et al. | 162/72 |
| 5,250,152 | A | 10/1993 | Ling et al. | |
| 5,298,120 | A | 3/1994 | Blackstone | 162/76 |
| 5,501,769 | A | 3/1996 | Blackstone et al. | |
| 5,728,265 | A | 3/1998 | Saint Victor et al. | |
| 5,871,663 | A * | 2/1999 | Turner | 162/72 |

FOREIGN PATENT DOCUMENTS

WO WO 99/20828 4/1999

* cited by examiner

*Primary Examiner*—Eric Hug
(74) *Attorney, Agent, or Firm*—Michael B. Martin; Thomas M. Breininger

(57) ABSTRACT

This invention is a method of reducing the resin content of chemical pulps comprising heating wood chips in an aqueous alkaline medium in the presence of an effective deresinating amount of an alkyl alcohol alkoxylate of formula $RO[(CH_2CHCH_3O)_x(CH_2CH_2O)_y]M$ wherein R is $C_4$ to $C_{40}$ alkyl; x is 1–50; y is 0–100 and M is H or an alkali metal, a cooking liquor comprising sodium hydroxide and sodium sulfite and the alkyl alcohol alkoxylate and a deresinated pulp prepared according to the method.

16 Claims, No Drawings

METHOD OF DERESINATING PULP USING ALKYL ALCOHOL ALKOXYLATE SURFACTANTS

TECHNICAL FIELD

This invention relates to the chemical processing of wood pulps to reduce resin content. More particularly, this invention is the use of alkyl alcohol alkoxylate surfactants in kraft and sulfite cooking processes.

BACKGROUND OF THE INVENTION

In the pulping process, delignification is the primary reaction that allows wood fibers to be separated from one another. Various mechanical and chemical methods are used to effect this separation, but the most widely used technique is known as kraft or sulfite process, since it produces pulp which gives high strength and good aging properties to paper products.

In the kraft process, a cooking liquor (white liquor) of sodium hydroxide and sodium sulfite is used to extract the lignin from wood. The process of extraction or delignification is carried out in digesters, either batch or continuous. The pH in the digester is generally between about 11 and about 14.

The liquor temperature is maintained between about 150 to about 175° C. A period of from about 2 to about 3 hours is usually required for complete digestion. The pulp is then washed before being further treatment such as bleaching prior to manufacture of paper products.

Cooking liquor penetration of wood chips is vital to the success of the pulping process. Pulp uniformity correlates directly with the ease of paper manufacturing operations and quality of end products. Adequate movement of cooking liquor into the wood is an essential first step in the pulping process. Removal of sufficient lignin for fiber liberation requires the penetration and diffusion of pulping liquor into the chip and then uniform distribution throughout the wood.

The two mechanisms that transport cooking chemicals into wood are penetration and diffusion. Penetration is the flow of cooking liquor into wood pores, while diffusion is the transport of dissolved chemicals as a result of a concentration gradient.

In kraft digesters, nonuniformity results from different wood species, chip size, chip age, errors in determining chip moisture content and pulping conditions. If the chips are too thick, a less homogenous pulp is produced because the alkali in the chip is consumed faster than it can be replaced by diffusion. Thus, the outer fibers are extensively delignified before the inner core has had an opportunity to react. The thickness of chips is always variable on a commercial scale. Deficient penetration during cooking results in higher screen rejects and shives in the final pulp, a high lignin content at a given yield, and inferior bleachability and end-use properties.

Nonuniform pulping can also occur in chips due to the interference of resin content. The resin in wood is primarily located in the parenchyma cells and lumen. The intact cell walls effectively protect the resin from contact with cooking chemicals.

Digestion and deresination can be considered to occur in the following manner:

1) Wetting of wood chips and resin by an aqueous alkaline fluid;
2) Penetration of the wood chips by this fluid;

3) Break-up resin and fatty acid aggregates and defibering of the wood chips promoted by invasion of aqueous alkaline fluid into the chip flow channels; and
4) Stabilizing dispersed resin particles thus reducing their redeposition onto cellulose fibers.

Surfactants can aid the above steps of the process through different mechanisms such as wetting, emulsifying, and dispersing these resinous materials into and out of wood structure. This results in a lower pulp resin content after cooking and washing stages. For dissolving grade pulps, it is necessary to reduce the pulp resin content to very low levels to prevent adverse effects of resin on acetate and viscose properties. In papermaking pulps, these extractives, when liberated during the processing of the wood chips to pulp and paper products, can cause troublesome pitch deposits on mill equipment, press picking and off quality production. Hence, effective pulp deresination aids can be useful in the manufacture of paper pulps as well as dissolving pulps.

U.S. Pat. No. 5,728,265 discloses the use of alkoxylated branched and unbranched aliphatic alcohols having 3 to 22 carbon atoms as chip penetrants.

SUMMARY OF THE INVENTION

This invention is a method of reducing the resin content of chemical pulps comprising heating wood chips in an aqueous alkaline medium in the presence of an effective deresinating amount of an alkyl alcohol alkoxylate of formula $RO[(CH_2CHCH_3O)_x(CH_2CH_2O)_y]M$ wherein R is $C_4$ to $C_{40}$ alkyl; x is 1–50; y is 0–100 and M is H or an alkali metal.

In another aspect, this invention is a cooking liquor comprising sodium hydroxide and sodium sulfite and an alkyl alcohol alkoxylate of formula $RO[(CH_2CHCH_3O)_x(CH_2CH_2O)_y]M$ wherein R is $C_4$ to $C_{40}$ alkyl; x is 1–50; y is 0–100 and M is H or an alkali metal.

In another aspect, this invention is a deresinated pulp prepared by heating wood chips in an aqueous alkaline medium in the presence of an effective deresinating amount of an alkyl alcohol alkoxylate of formula $RO[(CH_2CHCH_3O)_x(CH_2CH_2O)_y]M$ wherein R is $C_4$ to $C_{40}$ alkyl; x is 1–50; y is 0–100 and M is H or an alkali metal.

DETAILED DESCRIPTION OF THE INVENTION

"Alkyl alcohol" means compound or mixture of compounds of formula ROH where R is a straight or branched $C_4$–$C_{40}$ alkyl group.

"Hydroxide base" means the hydroxide (OH) salts of alkali metals such as sodium, potassium, calcium, magnesium lithium, and the like.

"White liquor" means an aqueous mixture of alkali metal hydroxide and a sulfite with or without further additives and in concentrations well known in the art. The Kappa number, which is directly proportional to the amount of lignin remaining in the pulp, is the volume (in milliliters) of 0.1 N potassium permanganate solution consumed by one gram of moisture-free pulp under the conditions specified in TAPPI method T 236 cm-85.

The alkyl alcohol alkoxylates of this invention have formula $RO[(CH_2CHCH_3O)_x(CH_2CH_2O)_y]M$ wherein R is $C_4$ to $C_{40}$ alkyl; x is 1–50; y is 0–50 and M is H or an alkali metal.

The alkyl alcohol alkoxylates are prepared by heating a $C_4$–$C_{40}$ alkyl alcohol, or mixture of $C_4$–$C_{40}$ alkyl alcohols, both designated herein as ROH, with propylene oxide, and optionally ethylene oxide in the presence of a hydroxide base. Preferably the reaction is conducted at a temperature of about 150° C. in a pressure vessel at a pressure of about 50 to about 75 psi. The resulting alkoxylate may be either left in salt form or neutralized with acid.

The ethylene oxide and propylene oxide may be added in random or block fashion. "Block polymer" means the polymer resulting from block addition of the propylene oxide and ethylene oxide. "Hetero polymer" means the polymer resulting from random addition of the propylene oxide and ethylene oxide.

Random addition of ethylene oxide and propylene oxide involves both components being added to the alcohol simultaneously, such that the rate of addition to the alcohol is controlled by their relative amounts and reaction rates. Thus, in the case of random addition, it is understood the above formula is not a structural formula but rather is representative only of the molar amounts, x and y, of ethylene oxide and propylene oxide that are added to the alcohol ROH.

In the case of block addition, either the ethylene oxide or propylene oxide is added first to the alcohol and allowed to react. The other component is then added and allowed to react. In the case of block addition, the above formula is representative of the structure of the alkoxylated alcohol, except that the $(C_2H_4O)_x$ and $(C_3H_6O)_y$ groups may be reversed depending on whether the propylene oxide or ethylene oxide is added first. The resulting polymer is a highly water soluble solid.

In a preferred aspect of this invention, M is H.

In another preferred aspect, M is K.

In another preferred aspect, R is $C_8$–$C_{22}$ alkyl.

In another preferred aspect, R is $C_{16}$ alkyl.

In another preferred aspect, x is 1–20.

In another preferred aspect y is 20–80.

In another preferred aspect, x is 1–20, y is 20–80 and X is H.

In another preferred aspect, the alkyl alcohol alkoxylate is a block polymer.

In another preferred aspect, the alkyl alcohol alkoxylate is a hetero polymer.

The method of this invention comprises contacting wood chips and the like with a digester aid which is a liquid mixture comprised of white liquor containing at least one alkyl alcohol alkoxylate surfactant as described herein to obtain pulp for producing paper. The surfactant concentration in the white liquor and the contact time with the pulp chips are each adjusted such that resinous components are extracted from the pulp without substantial degradation of cellulose. After contacting at least a portion of the wood chips with the digester aid, the combination is heated to a digestion temperature typically above about 150° C. The heating is also referred to as cooking.

The alkyl alcohol alkoxylate surfactant is preferably diluted with water and added as an aqueous solution to the white liquor after the liquor is diluted to a strength appropriate for the Kraft cook. The aqueous alkyl alcohol surfactant composition can also be added to a mixture of white and black liquor or black liquor only, or it can be used in treating the wood chips prior to adding the wood chips to the cooking liquor. After the wood has been digested to form a pulp slurry according to the present invention, and washed to remove the inorganics and dissolved organics, the pulp slurry is then provided to a papermaking machine. Paper may then be produced from the pulp slurry according to known procedures of papermaking. Although the specific percentages and process parameters described herein are preferred, other percentages and parameters may be utilized.

In a preferred aspect, the cooking is done at a temperature of about 150° C. to about 175° C.

In another preferred aspect, the cooking is done in the presence of about 0.5 to about 2 pounds per ton of alkyl alcohol alkoxylate on an oven dried chip basis.

The foregoing may be better understood by reference to the following examples, which are presented for purposes of illustration and are not intended to limit the scope of this invention.

EXAMPLE 1

Pulping Studies

Pulping studies are carried out in a Lorentzen & Wettre autoclave digester consisting of eight autoclaves (0.5 liter each) rotating in a heated glycol bath. In these experiments, a known amount of kraft cooking liquor (sodium hydroxide and sodium sulfite) is added into the wood chips to achieve the desired degree of pulp delignification. A 5% stock solution of each alkyl alcohol alkoxylate surfactant is prepared in a 100 ml volumetric flask. The surfactant charge is tested at a constant charge of 0.05% (o.d. chips). The surfactant solution is added to the kraft cooking liquor and thoroughly mixed before transferring into the autoclaves. A control experiment is also run simultaneously in each set.

Each of the autoclaves is charged with the wood chips and liquor, sealed and placed in the oil bath. The initial temperature of the oil bath is 50° C. The temperature is then ramped up and held at 170° C. for 1–3 hours to obtain the desired level of delignification. During the cook, the autoclaves rotate end-over-end to facilitate mixing and uniform heat transfer.

At the conclusion of the cook, the autoclaves are removed from the oil bath and the reaction is quenched by cooling the autoclaves to 40° C. for 10 minutes. The contents of the autoclaves are then disintegrated in a Waring blender for 2 minutes. The resulting pulp is extensively washed over a cheese cloth in a Buchner funnel and screened on a Voith flat screen with 0.20 mm slots. After screening, the rejects (un cooked material), kappa number (amount of residual lignin in the pulp), deresination (residual extractives in the pulp) and black liquor residual active alkali are determined.

The resin content of the chemical pulp is significantly reduced (65–70% deresination) when cooked in the presence of the alkyl alcohol alkoxylate surfactant of this invention. Furthermore, compared with other chemistries used commercially for deresination, the alkyl alcohol alkoxylate surfactant provides up to three fold higher deresination efficiency, resulting in improved deresination at substantially lower additive levels (0.5–1 lb/ton of pulp) compared to the currently used conventional chemistries (2–3 lb/ton of pulp).

Although this invention has been described in detail for the purpose of illustration, it is to be understood that such detail is solely for that purpose and that numerous modifications, alterations and changes can be made therein by those skilled in the art without departing from the spirit and scope of the invention except as it may be limited by the claims. All changes which come within the meaning and range of equivalency of the claims are to be embraced within their scope.

The invention claimed is:

1. A method of reducing the resin content of chemical pulps comprising heating wood chips in an aqueous alkaline medium in the presence of an effective deresinating amount of one or more deresinating aids, wherein the deresinating aids are selected from the group consisting of alkyl alcohol alkoxylates of formula $RO[(CH_2CHCH_3O)_x(CH_2CH_2O)_y]M$ wherein R is $C_8$–$C_{22}$ alkyl; x is 1–20; y is 20–80 and M is H or an alkali metal.

2. The method of claim 1 wherein M is H.

3. The method of claim 1 wherein M is K.

4. The method of claim 1 wherein R is $C_{16}$ alkyl.

5. The method of claim 1 wherein the alkyl alcohol alkoxylate is a block polymer.

6. The method of claim 1 wherein the heating is done at a temperature of about 150° C. to about 175° C.

7. The method of claim 1 wherein heating is done in the presence of about 0.5 to about 2 pounds per ton of alkyl alcohol alkoxylate on an oven dried chip basis.

8. A cooking liquor comprising sodium hydroxide and sodium sulfite and and one or more deresinating aids wherein the deresinating aids are selected from the group consisting of alkyl akohol alkoxylates according to claim 1.

9. A method of reducing the resin content of chemical pulps comprising heating wood chips in an aqueous alkaline medium in the presence of an effective deresinating amount of one or more surfactants wherein the surfactants are selected from the group consisting of alkyl alcohol alkoxylates of formula $RO[(CH_2CHCH_3O)_x(CH_2CH_2O)_y]M$ wherein R is $C_8$–$C_{22}$ alkyl; x is 1–20; y is 20–80 and M is H or an alkali metal.

10. The method of claim 9 wherein M is H.

11. The method of claim 9 wherein M is K.

12. The method of claim 9 wherein R is $C_{16}$ alkyl.

13. The method of claim 9 wherein the alkyl alcohol alkoxylate is a block polymer.

14. The method of claim 9 wherein the heating is done at a temperature of about 150° C. to about 175° C.

15. The method of claim 9 wherein heating is done in the presence of about 0.5 to about 2 pounds per ton of alkyl alcohol alkoxylate on an oven dried chip basis.

16. A cooking liquor comprising sodium hydroxide and sodium sulfite and one or more surfactants, wherein the surfactants are selected from the group consisting of the alkyl alcohol alkoxylates according to claim 9.

* * * * *